US009822475B2

(12) United States Patent
Thorpe

(10) Patent No.: US 9,822,475 B2
(45) Date of Patent: Nov. 21, 2017

(54) LOADING DEVICE FOR A LAUNDRY MACHINE

(71) Applicant: James Christopher Thorpe, Panama City, FL (US)

(72) Inventor: James Christopher Thorpe, Panama City, FL (US)

(73) Assignee: JENSEN USA INC., Panama City, FL (US)

( * ) Notice: Subject to any disclaimer, the term of this patent is extended or adjusted under 35 U.S.C. 154(b) by 1365 days.

(21) Appl. No.: 13/648,590

(22) Filed: Oct. 10, 2012

(65) Prior Publication Data

US 2014/0096573 A1 Apr. 10, 2014
US 2017/0114491 A9 Apr. 27, 2017

Related U.S. Application Data

(63) Continuation-in-part of application No. 13/273,600, filed on Oct. 14, 2011, now abandoned.

(51) Int. Cl.
*D06F 39/00* (2006.01)
*D06F 37/10* (2006.01)

(52) U.S. Cl.
CPC ..... *D06F 37/10* (2013.01)

(58) Field of Classification Search
CPC ..... D06F 95/00; D06F 95/002; D06F 95/004; D06F 95/006; D06F 37/10; D06F 37/18; D06F 37/28; D06F 39/14; D06F 49/003; D06F 58/18; E04F 17/12; E04F 17/123; E04F 17/126; A63B 69/0071;
(Continued)

(56) References Cited

U.S. PATENT DOCUMENTS 2,133,540 A * 10/1938 Jacobs ..... A61G 5/08 297/42
2,508,268 A * 5/1950 Knowlton ..... D06F 95/00 68/210
(Continued)

FOREIGN PATENT DOCUMENTS

DE 102006027615 A1 * 12/2007 ..... D06F 39/12
SE WO 2008104261 A2 * 9/2008 ..... D06F 29/00

OTHER PUBLICATIONS

DE102006027615—Machine Translation, Dec. 2007.*

*Primary Examiner* — Michael Kornakov
*Assistant Examiner* — Marc Lorenzi
(74) *Attorney, Agent, or Firm* — Merek, Blackmon & Voorhees, LLC

(57) ABSTRACT

A loading device is attachable to the front of a front-loading laundry machine comprising a drum, a drum port and a drum port door for selectively closing the drum port. The loading device comprises a deformable chute mounted on a collapsible frame, and a pair of brackets for mounting the collapsible frame to the laundry machine such that the loading device is configurable between: a use condition in which he collapsible frame is open and the deformable chute is taut for directing laundry through the drum port into the laundry machine, and a storage condition in which the collapsible frame is closed for allowing the drum port door of the laundry machine to be closed. A front-loading laundry machine provided with the loading device located adjacent the drum port. The front-loading laundry machine may be a washing machine or a tumble dryer.

10 Claims, 4 Drawing Sheets

(58) Field of Classification Search
CPC ..... A63B 63/083; A62B 1/20; A61G 1/013; B65B 67/1206; Y10S 29/102
USPC ..... 68/210, 235 R
See application file for complete search history.

(56) References Cited

U.S. PATENT DOCUMENTS 2,904,897 A * 9/1959 Whyte ..... D06F 95/004 34/90
3,464,733 A * 9/1969 Shaw ..... B65D 88/1612 294/68.21
3,505,836 A * 4/1970 Langston ..... D06F 39/12 68/208
3,583,748 A * 6/1971 Arndt ..... D06F 95/004 193/25 C
4,015,930 A * 4/1977 Grantham ..... D06F 95/00 34/129
4,835,993 A * 6/1989 Dreher ..... D06F 95/00 68/142
5,357,772 A * 10/1994 Hendren ..... D06F 95/00 68/210
5,449,083 A * 9/1995 Dougherty ..... A01D 51/00 220/9.1
5,700,293 A * 12/1997 Rydell ..... D06F 95/002 232/1 B
6,463,768 B1 * 10/2002 Shaw ..... D06F 95/00 68/210
6,671,978 B1 * 1/2004 McGowan ..... D06F 29/00 34/527
2004/0123635 A1 * 7/2004 Harfmann ..... D06F 95/00 68/210
2005/0076454 A1 * 4/2005 Duffy ..... D06F 95/00 8/158
2007/0113599 A1 * 5/2007 Harfmann ..... D06F 95/00 68/235 R
2013/0014403 A1 * 1/2013 Blair ..... B65G 11/203 34/165

* cited by examiner

LOADING DEVICE FOR A LAUNDRY MACHINE

CROSS-REFERENCE TO RELATED APPLICATION

This application is a continuation-in-part of prior application Ser. No. 13/273,600, filed Oct. 14, 2011, which is hereby incorporated herein by reference in its entirety.

FIELD OF THE INVENTION

The present invention relates to washing machines and tumble dryers of the type used in commercial laundries for cleaning and drying batches of laundry.

BACKGROUND OF THE INVENTION

In commercial laundries, batches of washing are typically delivered to the washing machines by means of an overhead rail laundry transfer system having a railed storage area in which the soiled articles to be washed are sorted into select batches. The batches of dirty laundry are typically loaded into respective containers, typically bags, suspended from the overhead rails and held in a storage area. The bags are then moved from the storage area and around the laundry to a washing machine and the dirty washing loaded into the washing drum of the machine.

The washing machines are generally front loaders and laundry may be discharged into a cart and then loaded into the machine manually. Alternatively, the suspended container may be manoeuvred so that it can be discharged directly into the door of the machine. This is not always successful and the operator may need to retrieve items from the floor and/or may need to manually distribute the dirty laundry in the machine. A similar problem exists with loading batches of washed laundry into a tumble dryer, which are also generally front loaders.

SUMMARY OF THE INVENTION

According to a first aspect of the present invention, there is provided a loading device attachable to the front of a front-loading laundry machine, said laundry machine comprising a drum, a drum port and a drum port door for selectively closing the drum port; said loading device comprising: a deformable chute mounted on a collapsible frame, and a pair of brackets for mounting said collapsible frame to said laundry machine such that said loading device is configurable between: a use condition in which said collapsible frame is open and the deformable chute is taut for directing laundry through said drum port into said laundry machine, and a storage condition in which said collapsible frame is closed for allowing the drum port door of said laundry machine to be closed.

In an embodiment, said collapsible frame comprises an inner part and an outer part pivotable relative to the inner part between: a raised position, in which the collapsible frame is open to hold said deformable chute taut, and a lowered position, in which the collapsible frame is closed. In an embodiment, the loading device comprises a locking means for holding the outer part in a raised position, to hold said deformable chute taut According to a second aspect of the present invention, there is provided a front-loading laundry machine comprising a drum, a drum port and a drum port door for selectively closing the drum port, said front-loading laundry machine provided with the loading device of the first aspect located adjacent the drum port.

In an embodiment, the front-loading laundry machine is a washing machine.

In an embodiment, the front-loading laundry machine is a tumble dryer.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE EMBODIMENTS

Figure 1:
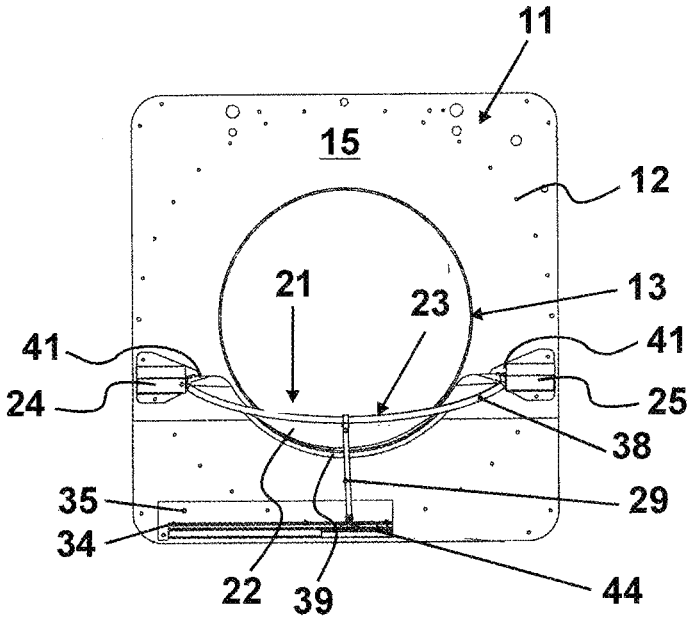
FIG. 1 shows a front view of a first loading device mounted on the front plate of a laundry machine having a drum for receiving laundry to be washed and/or dried, in a use condition.

There will now be described by way of example a specific mode contemplated by the inventor(s). In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

FIGS. 1 to 5 show a front-loading laundry machine of the type used in a commercial laundry and a loading device 21. The laundry machine has a drum for receiving laundry to be washed and/or dried. The laundry machine defines a drum port through which laundry can be loaded into the drum of the laundry machine, and through which laundry can be unloaded from the drum of the laundry machine. The laundry machine also has a drum port door for selectively closing the drum port. The laundry machine may be a washing machine or a tumble dryer.

A face plate 11 is mounted on the front casing of the laundry machine by any suitable means, for example by mechanical fixings such as bolts 12. The face plate 11 defines a port 13 through which laundry can be loaded into the drum of the laundry machine. The port 13 is then closed by a co-operating door 14 (shown in FIG. 4), which is also mounted on the face plate 11 by any suitable means, for example by mechanical fixings The port 13 is typically circular, as shown in FIGS. 1 to 5.

The loading device 21 is mounted on the front surface 15 of the face plate 11 of the laundry machine, adjacent the port 13. The loading device 21 comprises a readily deformable chute 22 mounted on a collapsible frame 23. The collapsible frame is attached to the front surface 15 of the face plate 11 of the laundry machine by a pair of brackets 24, 25. The two brackets 24, 25 are secured on the front surface 15 of the face plate 11 of the laundry machine, with one on each side of the port 13.

The collapsible frame 23 comprises two relatively moveable parts, an inner part 26 and an outer part 27, with the deformable chute 22 secured to the inner and outer part 26, 27. The inner part 26 of the collapsible frame 23 is arcuate, and extends around the lower outer periphery of the port 13. The inner part 26 of the collapsible frame 23 is held stationary by the pair of brackets 24, 25. The outer part 27 is also arcuate, and is pivotally mounted on the pair of brackets 24, 25. Both the inner and outer parts 26, 27 take the form of a curved bar, each being a sector of an associated circle having a diameter. The diameter of the circle associated with the outer part 27 is greater than the diameter of the circle associated with the inner part 26. The radius of curvature of the outer part 27 is greater than the radius of curvature of the inner part 26.

Figure 2:
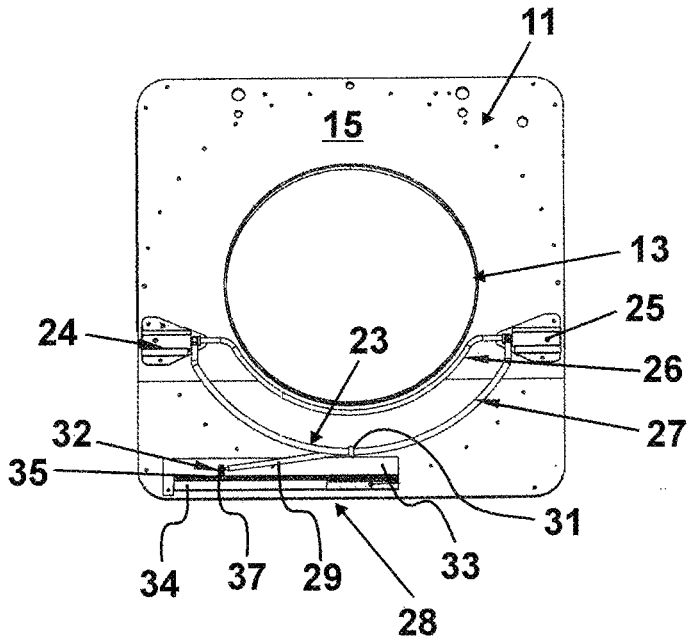
FIG. 2 shows a front view of the loading device of FIG. 1 mounted on the front plate of a laundry machine, in a storage condition.
Figure 3:
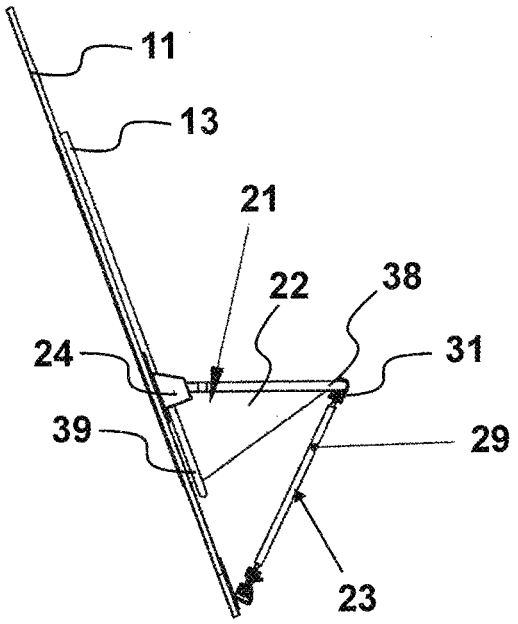
FIG. 3 shows a side view of the loading device of FIG. 1, in a use condition.

The outer part 27 of the collapsible frame 23 is pivotable relative to the inner part 26 between a use condition, as shown in FIGS. 1, 3, 4 and 5, and a storage condition, as shown in FIG. 2. In the use condition of the collapsible frame 23, the outer part 27 is in a raised position, or open, and the deformable chute 22 is held taut between the inner and outer parts 26, 27. In the storage condition of the collapsible frame 23, the outer part 27 is in a lowered position, or closed, and the deformable chute 22 is folded or otherwise relaxed and no longer held taut.

It can be seen from FIGS. 1 and 2, that when the collapsible frame 23 is in the use condition, the outer part 27 is located across the front of, the port 13, and when the collapsible frame 23 is in the storage condition, the outer part 27 is located away from the front of the port 13.

The outer part 27 of the collapsible frame 23 is held in the open position by a locking means 28, so as to hold the deformable chute 22 in a taut condition. In this illustrated embodiment, the locking means 28 takes the form of a strut 29. A first end of the strut 29 is connected by a pivot 31 to the outer part 27 of the collapsible frame 23. The other, second end of the strut 29 is connected by a pivot 32 to a location means 33 on the front surface 15 of the face plate 11 of the laundry machine.

The location means 33 comprises an elongate rail 34 secured to the front surface 15 of the face plate 11 of the laundry machine. The mounting plate is 35 is secured to the face plate 11 of the laundry machine by any suitable means, for example by mechanical fixings such as bolts. The rail 34 is provided with a longitudinally extending groove 36 (shown in FIG. 5). The second end of the strut 29 is connected via pivot 32 to a slider 37 that is moveable along the longitudinally extending groove 36 to different locations along the rail 34.

The slider 37 may be locked in each of a plurality of different locations along the groove 36 by any suitable means, such that in one location the collapsible frame 23 is collapsed and in a storage condition, and in another location the collapsible frame 23 is held open in a use condition with the deformable chute 22 held taut.

In this embodiment, the slider 37 is allowed to travel along the groove 36 to pass through a location in which the deformable chute 22 of the collapsible frame 23 is in a condition of maximum tautness before being located at limit stop 44, to prevent inadvertent collapse of the deformable chute 22.

Figure 4:
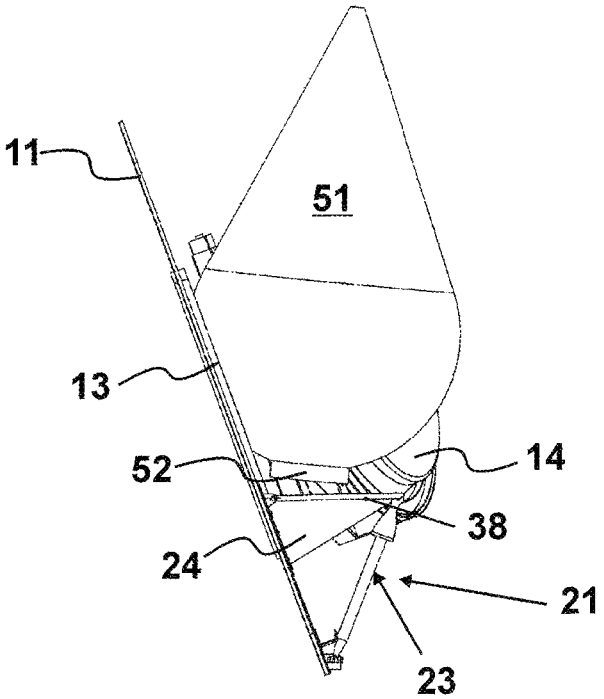
FIG. 4 shows a side view of the loading device of FIG. 1, in use receiving a batch of laundry for discharge into the drum of a laundry machine.
Figure 5:
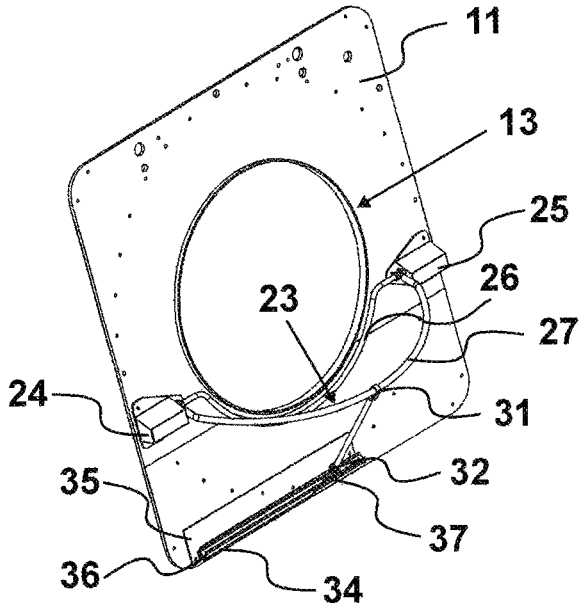
FIG. 5 shows a perspective view of the loading device of FIG. 1.

With particular reference now to FIG. 4, there is shown a filled laundry bag 51 and a laundry machine provided with a loading device 21. The door 14 of the laundry machine is open, and the loading device 21 is locked in the in use condition, with the deformable chute 22 held taut. The laundry bag 51 is suspended from an over head rail system (not shown), and is being delivered to the port 13, for loading into the drum of the laundry machine. In the use condition, the deformable cute 22 is held taut, and is oriented at an angle to the front of the laundry machine to form a sloping surface extending from the lower end of the port 13, upwards and outwards and around the margin of the port 13. In this arrangement, the taut chute 22 can serve to direct any laundry loaded thereon towards the port 13.

The bottom of the laundry bag 51 is provided with a closable aperture 52 that is opened to discharge the laundry from the laundry bag 51 onto the chute 22. The discharged laundry is then tumbled into the drum of the laundry machine from the chute 22, possibly with a degree of manual assistance from an operative directing laundry into the laundry machine. Thereafter, the emptied laundry bag 51 is removed from the vicinity of the chute 22, and the collapsible frame 23 is collapsed into the storage condition to permit closure of the door 14 the laundry machine, for operation of the loaded laundry machine.

The loading device is conveniently configurable between a use condition, for receiving laundry for delivery into a drum of a laundry machine and to prevent spillage of laundry onto the floor, and a storage condition for allowing the door of the laundry machine to be closed in preparation for operation of the loaded laundry machine.

According to the embodiment of FIGS. 1 to 5, the loading device is manually openable and closable between storage and use conditions. Additionally or alternatively, an actuator is provided to allow the loading device to be opened and closed between the use and storage conditions without manual handling. A manually operable button, switch, lever or other actuator activating means may be provided as appropriate to allow a user to selectively operate the actuator. The actuator may be of any suitable type, for example an electric or pneumatic actuator.

It is to be appreciated that the deformable chute of the loading device may be fabricated from any suitable material or combination of materials that will provide the requisite degree of folding or flexing for proper operation, for example a textile or a plastics material. The chute may be formed from: canvas; a woven polyester based material, for example a nylon; a woven cellulose based material, such as viscose; or a woven acrylonitrile based material.

In an embodiment, a sheet of material of the chute is cut to a suitable shape to allow the chute to be held taut between the inner and outer parts 26, 27 of the collapsible frame 23 when the loading device is in the use condition. At least one loop 38 is formed along the margin of the outer edge that is to be secured to the outer part 27 and at least one loop 39 is formed along the margin of the inner edge that is to be secured to the inner part 26 of the collapsible frame 23. The loops 38, 39 of the margins of these inner and outer edges of the chute 22 may be continuous loops forming tubes, as shown, or may be intermittent loops. The loops 38, 39 may be formed by looping the material of the chute back over itself and then securing the overlapping portions together. The overlapping portions of the loops 38, 39 may be permanently secured together by any suitable means, for example by sewing, adhering or use of mechanical fasteners. The inner and outer parts 26, 27 of the collapsible frame 23 are insertable into the loops 38, 39 prior to being assembled to the brackets 24, 25. End portions 41 of the chute material, adjacent the brackets 24, 25, are relieved to accommodate the movement of the collapsible frame 23.

In an alternative embodiment, the overlapping portions of the loops 38, 39 are releasably secured together by any suitable means, for example by zip fasteners, hook and loop fasteners, such as Velcro™, press studs or other type of releasable fastener, to allow the loops 38, 39 to be opened for receiving the inner and outer parts 26, 27 of the collapsible frame 23 therein and then closed around the inner and outer parts 26, 27.

Each component of the collapsible frame may be fabricated from any suitable material or combination of materials, for example a metal or a plastics material. The collapsible frame and chute may have any desired colouration or other feature of appearance. The deformable chute is advantageously removable from the collapsible frame for washing. Preferably, the material from which the deformable chute is made allows machine washing of the deformable chute.

Figure 6:
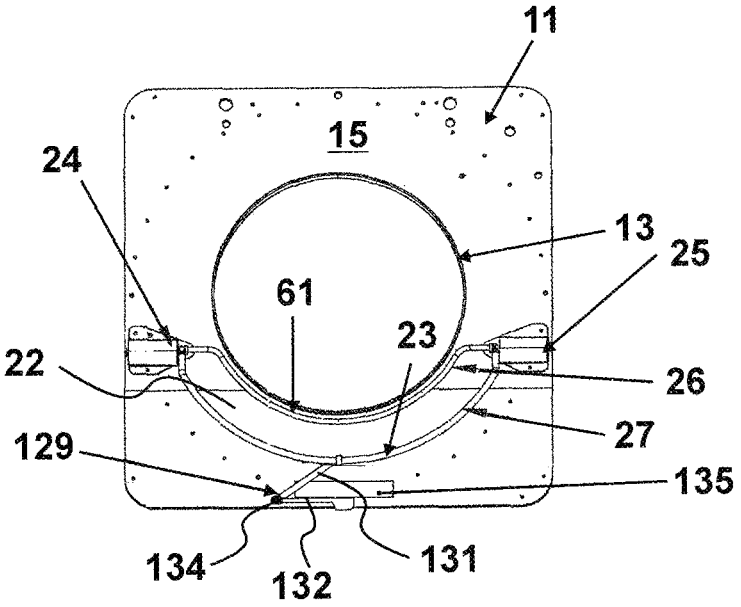
FIG. 6 shows a front view of a second loading device mounted on the front plate of a laundry machine, in a storage condition.

Turning now to FIG. 6, there is shown a second loading device 61, which is similar to the loading device 21 of FIGS. 1 to 5 but which differs from loading device 21 in respect of features that will now be described; where appropriate, the same reference numerals are used.

Loading device 61 is shown in FIG. 6 with collapsible frame 23 in the storage condition. In this embodiment, the strut 129 is formed from two parts, an upper part 131 and a lower part 132. The upper part 131 is pivotally connected to the outer part 27 of the collapsible frame 23. The lower part 132 is pivotally connected to a plate 135 on the front surface 15 of the face plate of the laundry machine. The upper and lower parts 131, 132 of the strut 129 are interconnected by an over-centre locking device 134, for locking the strut 129 is in an open condition, to hold the chute 22 of the loading device 61 taut.

In an alternative arrangement the strut 129 is formed from at least two telescopically arranged tubes, which are extendable from a shortened arrangement, in which the collapsible frame can take up a storage condition, into a lengthened arrangement in which the tubes are lockable relative to each other to hold the collapsible frame in a use condition, to hold the chute taut.

In a further alternative embodiment, the strut 129 is formed from a plurality of sections arranged to allow the removal or addition of at least one strut section from the strut 129, to adjust the length of the strut 129 to accommodate a dimensional requirement of the loading device for use with a particular laundry machine.

Figure 7:
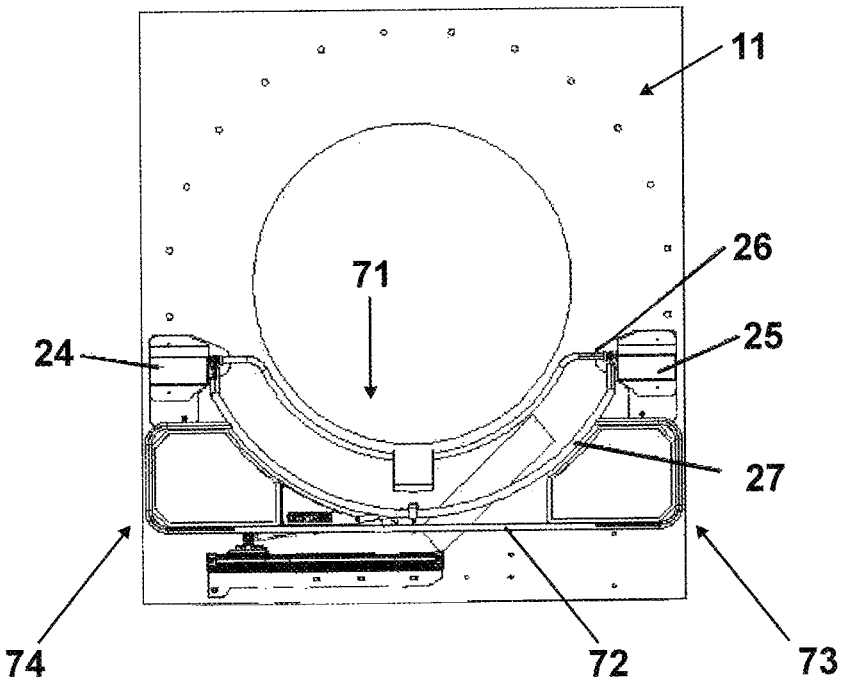
FIG. 7 shows a front view of a third loading device mounted on the front plate of a laundry machine, in a storage condition.
Figure 8:
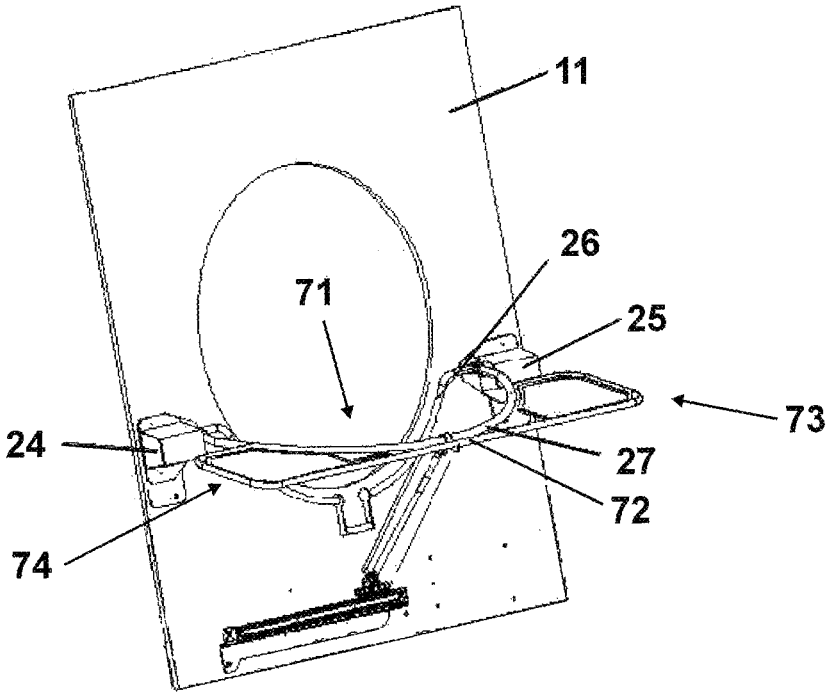
FIG. 8 shows a perspective view of the third loading device of FIG. 7, in a use condition.

Turning now to FIGS. 7 and 8, there is shown a third loading device 71, which is similar to the loading device 21 of FIGS. 1 to 5 but which differs from loading device 21 in respect of features that will now be described; where appropriate, the same reference numerals are used. The loading device 71 is provided with an additional frame member 72, that is shaped and dimensioned to provide a degree of protection to an operative standing to either side 73, 74 of the loading device 71 and laundry machine 11 from a basket of laundry delivered to the loading device 71. In this illustrated example, the additional frame member extends from the outer part 27. It can be seen from FIGS. 7 and 8, that the loading device 71 does not extend further sideward than the sides of the laundry machine 11, and the additional frame member 72 is dimensioned to be folded against the front face of the laundry machine 11 without reaching the floor. In an alternative example (not shown) the outer part 27 may be suitably profiled to provide the same functionality of the additional frame member 72 of the loading device 71.

It is to be appreciated that a loading device providing the functionality described herein may be provided with other features or variant features to those described herein. The loading device may have any suitable dimensions and any suitable elevation and orientation relative to the floor and a laundry machine. The collapsible frame and deformable chute may have such a suitable shape and dimensions to provide a degree of protection to an operative standing to a side of the loading device from a basket of laundry delivered to the loading device.

The invention claimed is:

1. A front-loading laundry machine including a drum having a circular port for loading laundry into said drum, said drum being one of a wash drum and a dryer drum, said front-loading laundry machine comprising a loading device mounted to a front surface of the front-loading laundry machine adjacent said circular port, said loading device comprising:

a collapsible frame comprising an inner frame part and an outer frame part;

a pair of brackets mounted to said front surface of said front-loading laundry machine at positions either side of said circular port;

a deformable textile chute mounted on said collapsible frame, wherein the inner frame part is arcuate and extends around a lower outer periphery of said circular port and is held by the brackets stationary relative to the brackets, and the outer frame part is pivotably held by the brackets and pivotable relative to the inner frame part between a collapsed position and a raised position, and wherein in the raised position said deformable textile chute is held taut by said frame between said inner and outer frame parts to form a chute for directing laundry through said circular port into said drum, and in the collapsed condition said deformable textile chute is held in a relaxed condition by said frame between said inner and outer frame parts;

and wherein said loading device further comprises a locking means for holding the outer frame part in said raised position, to hold said deformable textile chute taut, and wherein said loading device further comprises a location means comprising an elongate rail mounted to said front surface of said front-loading laundry machine;

and wherein said locking means of said loading device comprises a strut having a first end pivotally connected to the outer frame part of the collapsible frame and a second end connected to said location means, and wherein said second end of said strut is moveable along said elongate rail between a location in which said outer frame part is held in said raised position with the deformable textile chute held taut and another location in which said outer frame part is held in said collapsed position.

2. The A front-loading laundry machine as claimed in claim 1, further comprising a slider pivotally connected to said second end of said strut, said slider being slidably moveable along a groove formed within said elongate rail.

3. The front-loading laundry machine of claim 1, wherein said strut is adjustable in length.

4. The front-loading laundry machine of claim 3, wherein the strut is formed from a plurality of sections arranged to allow the removal or addition of at least one strut section from the strut, to adjust the length of the strut.

5. The front-loading laundry machine as claimed in claim 1, wherein said outer frame part of the collapsible frame is arcuate, and is pivotally mounted to the front-loading laundry machine by said brackets, and the radius of curvature of said outer frame part of the collapsible frame is greater than the radius of curvature of said inner frame part of the collapsible frame.

6. The front-loading laundry machine as claimed in claim 1, wherein at least one loop is formed along the margin of each of an inner edge and an outer edge of the deformable textile chute, said inner frame part being received in each loop along the margin of the inner edge, and said outer frame part being received in each loop along the margin of the outer edge.

7. The front-loading laundry machine as claimed in claim 6, wherein each loop along the margin of the inner edge and of the outer edge of the deformable textile chute is provided with a releasable fastener to allow each loop to be opened to receive the inner frame part or the outer frame part of the collapsible frame therein respectively and then closed around the inner and outer frame parts of the collapsible frame respectively.

8. The front-loading laundry machine as claimed in claim 1, wherein end portions of the deformable textile chute, adjacent the brackets, are relieved to accommodate the movement of the collapsible frame.

9. The front-loading laundry machine of claim 1, wherein the front-loading laundry machine is a washing machine.

10. The front-loading laundry machine of claim 1, wherein the front-loading laundry machine is a tumble dryer.

* * * * *